US005755116A

United States Patent [19]

Sparacino et al.

[11] Patent Number: 5,755,116

[45] Date of Patent: May 26, 1998

[54] REMEMBRANCE PRESERVING JEWELRY AND METHOD FOR ITS USE

[76] Inventors: Anthony Guy Sparacino, 203; Peggy Ann Sparacino, P.O. Box 203, both of Floral City, Fla. 34436

[21] Appl. No.: 735,430

[22] Filed: Oct. 22, 1996

[51] Int. Cl.[6] ..... A44C 5/00

[52] U.S. Cl. ..... 63/3; 63/18; 63/1.14

[58] Field of Search ..... 63/1.14, 3, 18, 63/19; 206/37, 246, 496, 811

[56] References Cited

U.S. PATENT DOCUMENTS

| | | | |
|---|---|---|---|
| 1,383,104 | 6/1921 | Grossman | 63/1.14 |
| 1,995,428 | 3/1935 | Keely | 63/18 X |
| 2,450,620 | 10/1948 | Speicher | 63/18 |
| 2,768,787 | 10/1956 | Czerwicznik | 63/18 X |
| 3,955,726 | 5/1976 | Reitzel | 63/19 X |
| 5,158,174 | 10/1992 | Hereford | 206/37 |

*Primary Examiner*—David M. Purol
*Attorney, Agent, or Firm*—American Innovations Inc.

[57] ABSTRACT

A piece of jewelry in the form of a necklace or bracelet which would have a permanently sealed, air-tight chamber within for secure containment of a small portion of the ashes of a loved one, baby teeth of a child, or a lock of hair of someone important to the user of the jewelry. The piece of jewerly may include more than one chamber for containment of ashes, teeth, or hair of more than one person important to the user. Also included is a method for sealing the same within such a piece of jewelry with silicone sealant. Applications may include, but are not limited to, use by grandparents to feel closer to a grandchild living at a remote distance from them, use by parents to commemorate important occasions involving their children, and use by boyfriends, girlfriends, and spouses for feeling closer to the one they love particularly when facing a separation, such as that required by military duty.

8 Claims, 3 Drawing Sheets

BEST AVAILABLE COPY
Figure 1
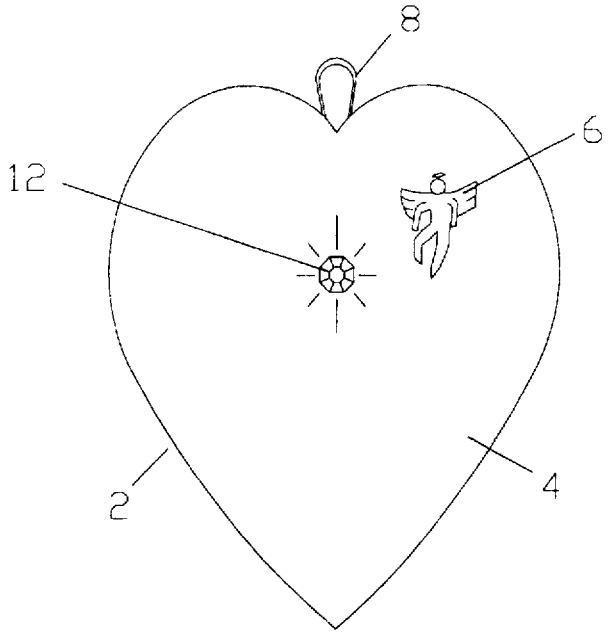
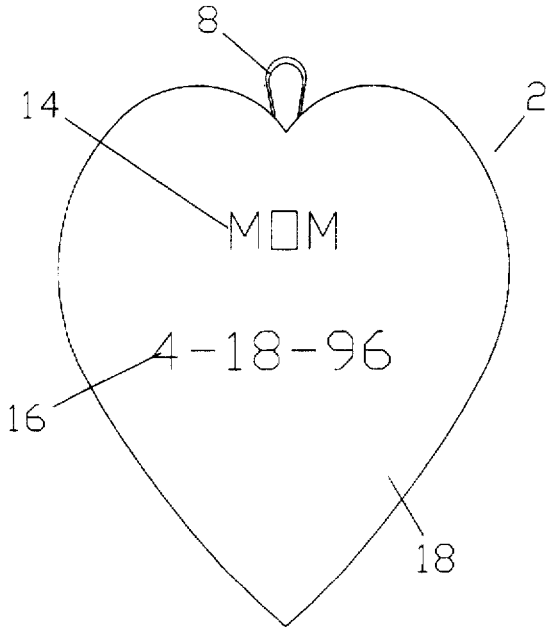
Figure 2

BEST AVAILABLE COPY

BEST AVAILABLE COPY

REMEMBRANCE PRESERVING JEWELRY AND METHOD FOR ITS USE

BACKGROUND—FIELD OF INVENTION

This invention relates to jewelry with hidden chambers therein for holding a variety of objects, specifically to jewelry in the form of necklaces and bracelets, and a method for its use in storing remembrances, the jewelry having at least one permanently sealed, air-tight chamber for secure containment of a small portion of the cremated ashes of a loved one, a baby tooth of a child, or a lock of hair of someone important to the user of the jewelry. Applications may include, but are not limited to, use by grandparents to feel closer to a grandchild living at a remote distance from them, use by parents to commemorate important occasions involving their children, and use by boyfriends, girlfriends, and spouses for feeling closer to the one they love particularly when facing a separation, such as that required by military duty.

BACKGROUND—DESCRIPTION OF PRIOR ART

People have a propensity to commemorate important events in their lives. At the recent Olympics, athletes were shown collecting sand from the track and field arena in which they had won medals. It has also been known for students at football games to tear down goal posts to obtain a commemorative remembrance of a football game that was important to their school. People have also been known to save and keep close at hand a lock of hair from a baby's first hair cut, the first baby tooth which falls out to make way for adult teeth, and the cremated ashes of a loved one. Therefore, it would be useful and comforting to some people to have a piece of jewelry with a hidden chamber therein for permanently sealing such a remembrance of a loved one and keeping such remembrance close at hand.

It is known to have jewelry and other pendants with compartments therein for holding small objects and photographs. For example, U.S. Pat. No. 3,670,524 to Korwin (1972) discloses a releasably securable setting for display of ornamental objects such as coins and U.S. Pat. No. 4,866,952 to Hight (1989) discloses a releasably sealed container for the storage of medications which is readily separable for easy access to the contents by incapacitated persons. Further, U.S. Pat. No. 5,390,510 to Titio-Cloonan (1995) discloses a heart-shaped pendant for housing scented fluids and U.S. Pat. No. 1,255,870 to Foster (1917) discloses an identification tag contemplated for suspension around the necks of soldiers and others which has an internal chamber for holding a photograph or other information to reveal the identity of the wearer. It is contemplated for the objects contained in all of these inventions to be releasably positioned within the inventions. In contrast, the present invention contemplates permanent and airtight sealing of the remembrance of a loved one within the jewelry compartment so that it cannot become separated from the jewelry and misplaced.

The prior art thought to be most closely related to the present invention is the invention disclosed in U.S. Pat. No. 5,158,174 to Hereford (1992). The Hereford invention discloses a jewelry container in the form of a pendant for holding cremation ashes and which comprises a minor container and a major container, the minor container being housed within the major container during use. It is contemplated for the minor container to be closed by a cap comprising an end plate and an end insert wherein the end cap can be permanently and hermetically sealed for secure containment of remembrance stored within by frictional engagement, metallic fusing, or by soldering the end plate to the minor container. It is also contemplated for a support piece to be secured to the top of the major container so that the nested major and minor containers can be suspended during use. The present invention can be distinguished from the Hereford invention which, as described above, comprises two nested containers with the innermost container being sealed by an end cap. In contrast, the present invention comprises two similarly sized and dimensioned components, a front cover and a back cover, each having a hollow interior for the housing of small objects. It is also contemplated for the present invention to allow the separate and distinct storage of more than one object. Also, alternatively, all of the objects may initially be placed within the jewelry and sealed at once, or some of the objects may be initially placed within one or two of the separate chambers in the compartment, allowing subsequently obtained objects to be placed within other chambers as the objects become available. Thus, a mother of several small children could house a baby tooth from each child, or a child could store and maintain separate a small portion of ashes from each parent or grandparent. Further, instead of frictionally engaging, metallically fusing, or soldering an end cap to a minor container, the present invention contemplates the simple use of silicone sealant to seal the treasured objects within the jewelry. It is not known to have jewelry in the form of necklaces and bracelets which would have an interior compartment for permanent and secure sealing therein of a small portion of the cremated ashes of a loved one, a baby tooth of a child, or a lock of hair of someone important to the user of the jewelry, which may comprise more than one chamber for such containment, and which has the remembrance simply sealed in an airtight manner within the jewelry using silicone sealant.

SUMMARY OF INVENTION—OBJECTS AND ADVANTAGES

It is the primary object of this invention to provide a piece of jewelry having a permanently sealable, air-tight hidden compartment therein for containing a remembrance of a loved one, such as a small portion of their cremated ashes, a lock of hair, or a tooth. It is also an object of this invention to provide pieces of jewelry with more than one interior chamber within the compartment for containing the ashes, hair, or teeth of more than one loved one. A further object of this invention is to provide a method for sealing the ashes, hair, or teeth of a loved one within a permanently sealable, air-tight compartment hidden within a piece of jewelry. It is also an object of this invention to provide jewelry in the form of both necklaces and bracelets having at least one permanently sealable, air-tight hidden chamber for containing the ashes, hair, or teeth of a loved one.

As described herein, properly manufactured and used, the present invention would provide a simple-to-use means by which someone can keep close at hand a remembrance of a loved one. It is contemplated for the present invention to be used for storing such items as a baby tooth from a child or grandchild, a lock of hair commemorating a special occasion, or a small portion of the cremated ashes of someone important to the user. The present invention comprises a front cover and a back cover, each having a hollow cavity therein for containing small objects. One or more dividers may be positioned within the cavity ito form separate chambers within the back cover to keep the objects stored therein separated from one another. It is contemplated for the front and back cover to be permanently sealed together with silicone sealant when all of the objects for storage within the jewelry are placed therein simultaneously. However, when the intent is for additional objects to be subsequently added to the jewelry, the front and back covers may remain separable, such as through threaded means, with inner chambers separately and permanently sealed by chamber covers attached thereto with silicone sealant, leaving additional compartments available for later use. It is contemplated for the jewelry to be made from yellow gold, white gold, and silver, and to have decorative markings, jewels, and etched information to the front and back covers to enhance the commemorative value of the jewelry to a user.

The description herein provides preferred embodiments of the present invention but should not be construed as limiting the scope of the jewelry invention. For example, variations in the configuration and dimension of the front and back covers, the thickness of the combined front and back covers, the size of the cavities in the front and back covers, and the number of dividers used, other than those shown and described herein, may be incorporated into the present invention. Thus the scope of the present invention should be determined by the appended claims and their legal equivalents, rather than the examples given.

BRIEF DESCRIPTION OF THE DRAWINGS

FIG. 1 is a front view of the invention in the form of a necklace pendant.

FIG. 2 is a back view of the invention in the form of a necklace pendant.

DETAILED DESCRIPTION OF PREFERRED EMBODIMENTS

Figure 3:
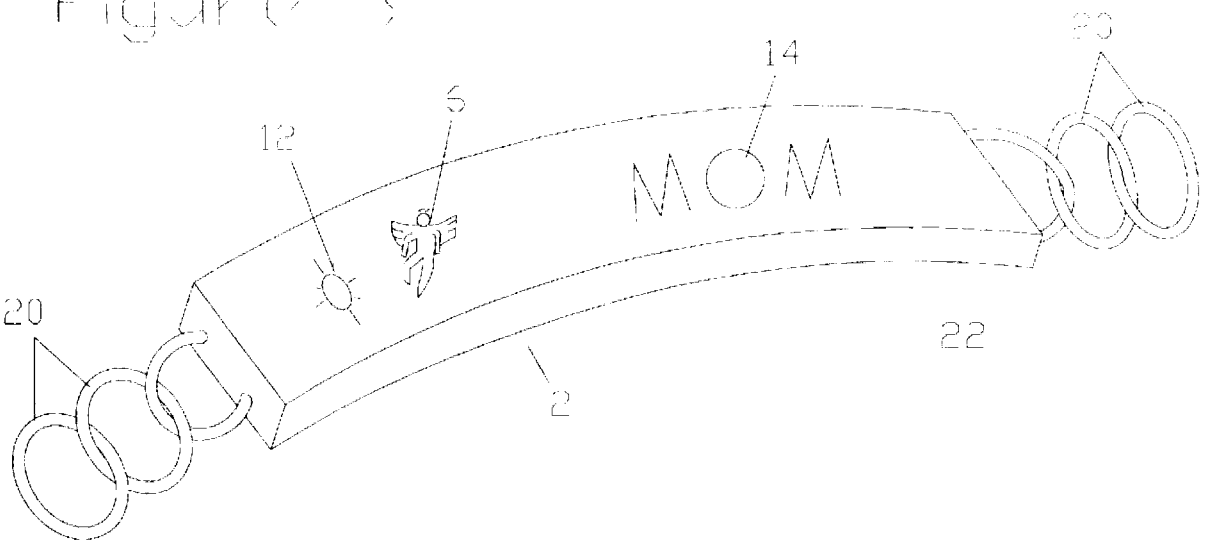
FIG. 3 is a perspective view of the invention in the form of a bracelet.

FIGS. 1 and 2 show a preferred embodiment of a piece of remembrance preserving jewelry 2 in the form of a pendant. FIG. 1 shows jewelry 2 comprising a front cover 4 and a connecting member 8 attached to the upper part of front cover 4, as well as decorative markings 6, and a decorative jewel 12 attached to the outside surface of front cover 4. FIG. 2 shows jewelry 2 having a back cover 18, connecting member 8 attached to the upper part of back cover 18, a date marking 16 etched into back cover 18, and a name identification 14 also etched into back cover 18. FIG. 3 shows jewelry 2 in the form of a bracelet and having an elongated front cover 22 connected on both ends to bracelet support members 20. In addition, FIG. 3 shows elongated front cover 22 having decorative markings 6, decorative jewel 12, and etched name identification 14 positioned thereon. The positioning of decorative markings 6, decorative jewels 12, and etched name identifications 14 relative to one another on the present invention is not critical.

Figure 4:
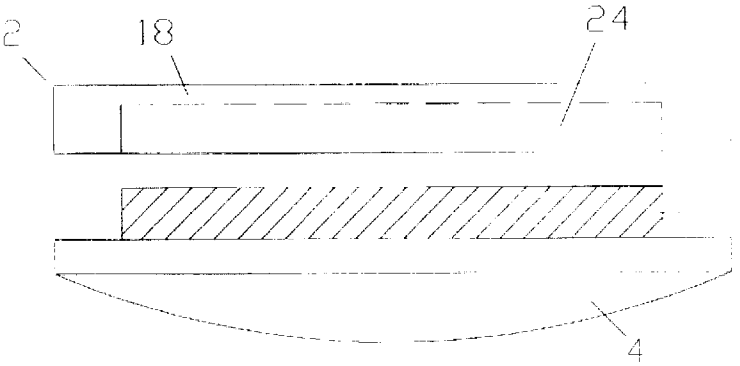
FIG. 4 is a side view of a first embodiment of the invention having a hidden compartment with an airtight seal.
Figure 5:
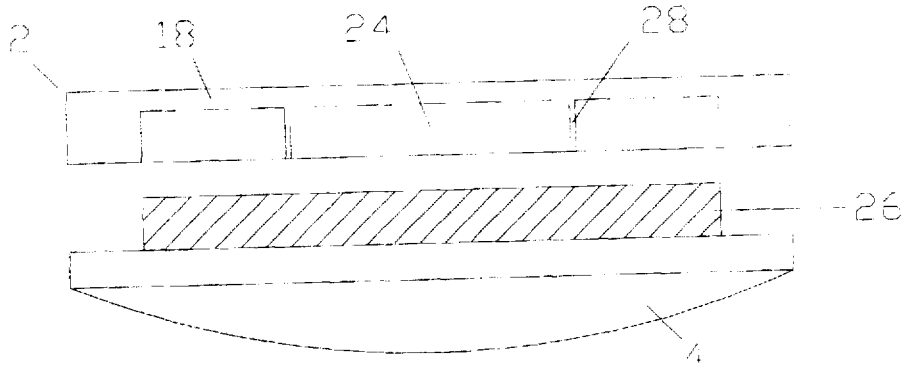
FIG. 5 is a sectional view of the first embodiment of the invention having a hidden compartment with an airtight seal and dividers within the compartment.
Figure 6:
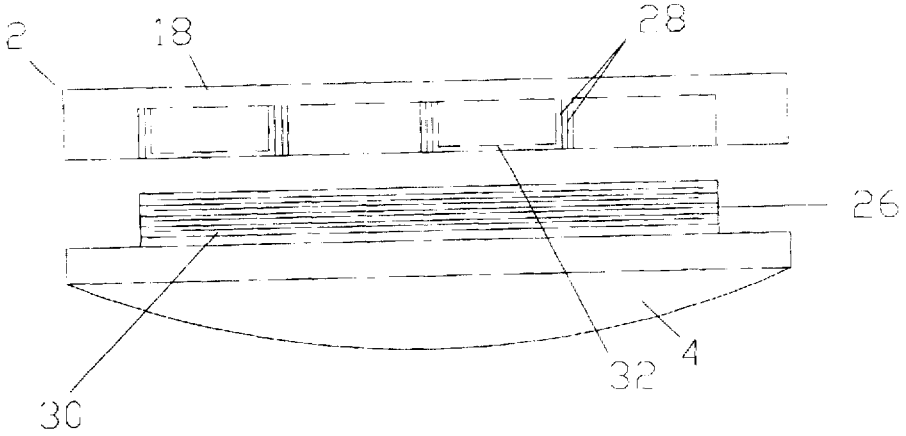
FIG. 6 is a sectional view of a second embodiment of the invention having a hidden compartment with a threaded seal and separate chambers therein each having an airtight seal through the use of separate chamber covers.

FIGS. 4, 5 and 6 show jewelry 2 having front cover 4 with a flange 26 depending rearwardly therefrom and back cover 18 having a cavity 24 therein with the opening of cavity 24 positioned toward flange 26. It is contemplated in FIGS. 4 and 5 to have an airtight sealing means, such as a silicone sealant applied to flange 26 for permanent sealing of front cover 4 to back cover 18 around remembrances of loved ones (not shown) to preserve such remembrances within cavity 24. In addition, FIG. 5 shows spaced apart dividers 28 positioned within cavity 24 for creating several distinct storage chambers therein for the separated storage of different objects (not shown). The number of dividers 28 used is not critical to the present invention, nor is the size of each distinct storage space within cavity 24 separated by dividers 28.

FIG. 6 shows an embodiment of the present invention having threaded means 30 for attaching front cover 4 to back cover 18, and separate chambers within back cover 18 which through the use of chamber covers 32 may be sealed in an airtight manner with silicone sealant to preserve remembrances (not shown) therein, such construction allowing the subsequent addition of future remembrances (not shown) to jewelry 2. In the preferred embodiment it is contemplated for jewelry 2 to be made of yellow gold, white gold, or silver, and for jewelry 2 to have a thickness ranging between one-eighth of an inch and three-sixteenths of an inch, and for the preferred pendant embodiment of the present invention to have a maximum length or width dimension ranging between one-half of an inch to one inch.

To use the present invention, one would place an item of value to the user within a cavity in back cover 18. After applying to a rearwardly depending flange 26 on front cover 4 a quantity of silicone sealant sufficient to seal back cover 18 to front cover 4, one would position the flange 26 within a cavity in back cover 18 and let sealant sit undisturbed for at least three hours to provide a secure connection of the flange 26 to back cover 18. After silicone sealant has cured, the present invention may be worn knowing that the contents are securely sealed therein without the possibility of inadvertent loss therefrom.

What is claimed is:

1. A piece of jewelry for permanently storing one or more objects therein so that said objects cannot become separated from said jewelry and lost, said piece of jewelry comprising a front cover having a back surface and a cavity, a back cover having a configuration and dimension similar to that of said front cover, said back cover also having front surface and a cavity with an opening communicating through said front surface, said front cover and said back cover being attached to one another in a closed position during storage of said objects, said opening in said cavity of said front cover communicating with said opening in said cavity of said back cover in said closed position; a flange rearwardly depending from said front cover for insertion within said cavity of said back cover, said flange configured to contact said back cover so as to seal said cavity in said back cover when said front cover and said back cover are in said closed position; said piece of jewelry further comprising airtight sealing means to permanently seal said objects within said cavity of said back cover.

2. The piece of jewelry of claim 1 further comprising a plurality of dividers positioned within said cavity of said back cover so as to form a plurality of distinct and separated chambers within said cavity of said back cover.

3. The piece of jewelry of claim 1 wherein said sealing means comprises a sufficient quantity of silicone sealant positioned on said flange to securely attach said front cover to said back cover.

4. The piece of jewelry of claim 1 wherein said sealing means comprises threaded means on said flange, mating threads within said cavity of said back cover, a plurality of chamber covers, and silicone sealant for securing each of said chamber covers to two of said dividers for use in separately storing said objects in distinct and identifiable chambers.

5. A method for sealing objects within a piece of jewelry formed from a front jewelry cover and a back jewelry cover so that said objects will not become separated from said piece of jewelry and misplaced, said method comprising the steps of providing a front jewelry cover, a back jewelry cover, and silicone sealant; placing at least one of said objects within a cavity in said back jewelry cover; applying a quantity of silicone sealant to a rearwardly depending flange on said front jewelry cover to sufficiently cover said flange for secure connection of said flange to said back jewelry cover; positioning said flange within a cavity in said back jewelry cover; and allowing said silicone sealant to cure for a minimum of several hours before wearing said piece of jewelry.

6. The method of claim 5 further providing the steps of providing a plurality of chamber covers; unscrewing threads on said flange to disconnect said flange from said back cover; inserting at least one of said objects within one of the chambers of said back cover; permanently attaching one of said chamber covers to the one of said chambers containing said object with silicone sealant; reconnecting said front cover to said back cover by mating said threads on said flange with threads in said cavity of said back cover; and repeating said steps of providing, inserting, permanently attaching, and reconnecting to add additional ones of said objects to any one of said chambers which remain unsealed.

7. A piece of jewelry for permanently storing one or more objects therein so that said objects cannot become separated from said jewelry and lost, said piece of jewelry comprising a front cover having a back surface and a cavity with an opening communicating through said back surface; a back cover having a configuration and dimension similar to that of said front cover, said back cover also having a front surface and a cavity with an opening communicating through said front surface, said front cover and said back cover being attached to one another in a closed position during storage of said objects, said opening in said cavity of said front cover communicating with said opening in said cavity of said back cover in said closed position; a flange rearwardly depending from said front cover for insertion within said cavity of said back cover, said flange configured to contact said back cover so as to seal said cavity in said back cover when said front cover and said back cover are in said closed positions; a plurality of dividers positioned within said cavity of said back cover so as to form a plurality of distinct and separated chambers within said cavity of said back cover; and said piece of jewelry further comprising airtight sealing means to permanently seal said objects within said cavity of said back cover, said sealing means further comprising threaded means on said flange, mating threads within said cavity of said back cover, a plurality of chamber covers, and silicone sealant for securing each of said chamber covers to two of said dividers for use in separately storing said objects in distinct and identifiable chambers.

8. A method for sealing objects within a piece of jewelry formed from a front jewelry cover and a back jewelry cover so that said objects will not become separated from said piece of jewelry and misplaced, said method comprising the steps of providing a front jewelry cover, a back jewelry cover, a plurality of chamber covers, a plurality of dividers forming a plurality of chambers within a cavity within said back jewelry cover and silicone sealant; placing at least one of said objects within one of said chambers in said back jewelry cover; applying a quantity of said silicone sealant to a chamber cover and permanently attaching said chamber cover to one of said chambers in said back jewelry cover; and attaching said front cover to said back cover by mating threads on a rearwardly depending flange on said front jewelry cover with threads on said back jewelry cover.

* * * * *